United States Patent [19]

Georgakis

[11] Patent Number: 4,898,276

[45] Date of Patent: Feb. 6, 1990

[54] STORAGE AND DISPENSING BOX FOR SMALL COMPONENTS

[75] Inventor: Evangelos G. Georgakis, Downey, Calif.

[73] Assignee: Unitek Corporation, Monrovia, Calif.

[21] Appl. No.: 137,812

[22] Filed: Dec. 23, 1987

[51] Int. Cl.[4] ..... B65D 83/10

[52] U.S. Cl. ..... 206/369; 206/370; 220/346; 220/347

[58] Field of Search ..... 220/346, 347; 206/45.11, 369, 370, 45.14

[56] References Cited

U.S. PATENT DOCUMENTS 1,933,894 11/1933 Clink ..... 206/373
2,506,385 5/1950 Roamer ..... 206/45.11
3,960,270 6/1976 May .
4,062,445 12/1977 Moe ..... 220/346
4,340,140 7/1982 Wilcox et al. ..... 220/346

*Primary Examiner*—Joseph Man-Fu Moy
*Attorney, Agent, or Firm*—Donald M. Sell; Walter N. Kirn; James D. Christoff

[57] ABSTRACT

A multicompartment box for storing and dispensing sets of small parts such as orthodontic brackets. The box has a vacuum-formed base with cavity-like depressions for receiving the parts, and a transparent lid is slidably mounted on the base to cover and uncover the parts. The base defines button-like buttons or projections which fit into mating lid grooves arranged to retain the lid on the box, and to releasably secure the lid in the closed position.

8 Claims, 4 Drawing Sheets

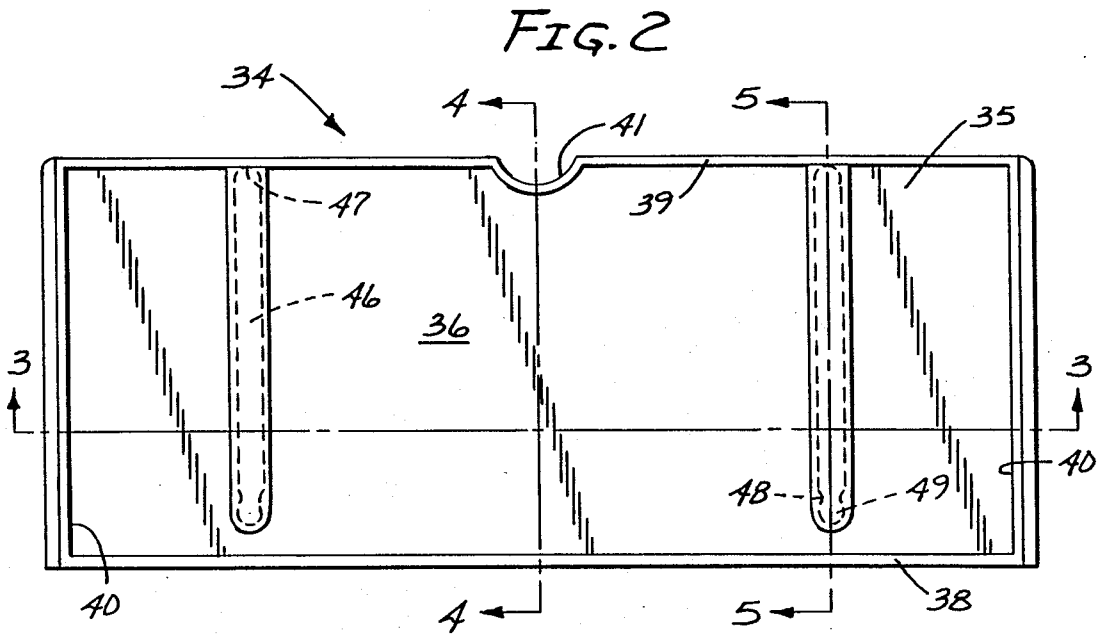
FIG. 2
34
35
36
37
38
39
40
41
42
43
45
46
47
48
49
3
4
5
6
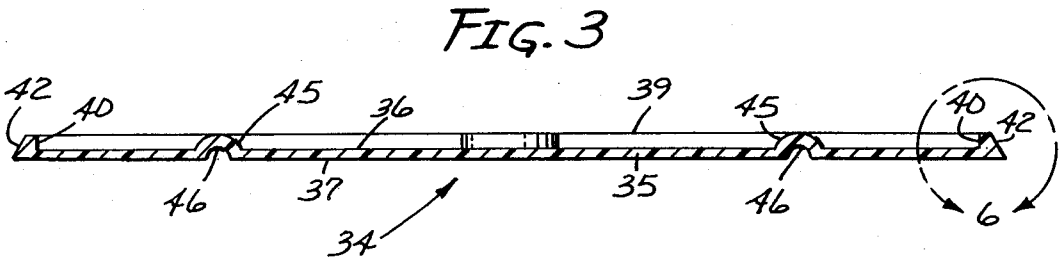
FIG. 3
34
35
36
37
39
40
42
45
46
6
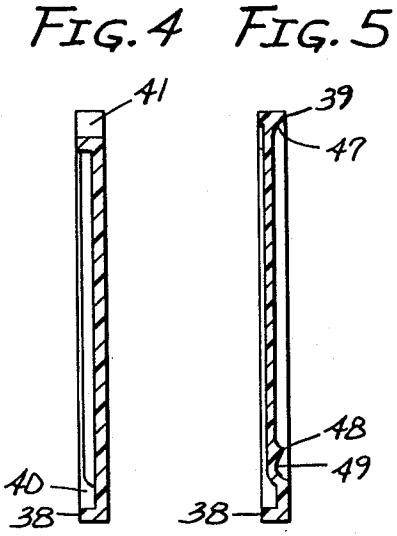
FIG. 4
38
40
41
FIG. 5
38
39
47
48
49
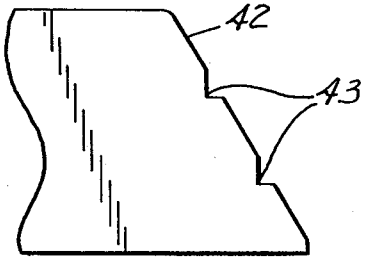
FIG. 6
42
43

STORAGE AND DISPENSING BOX FOR SMALL COMPONENTS

BACKGROUND OF THE INVENTION

This invention is directed to a multicompartment package or box for secure storage of quantities of a multiplicity of small parts which must be kept separated and not intermixed during handling or shipment, and yet be easily accessible for selection and use. The box was originated to solve a specific problem faced by orthodontists as discussed below, and will be described in the context of that application. The box is equally useful, however, in other situations requiring isolated storage of many small parts, coupled with ease of access and selection when the parts are needed.

Orthodontists use appliances called orthodontic brackets made of metal, plastic or ceramic materials, and which are used to couple a force-applying device (such as an archwire) to teeth. Brackets are designed for specific teeth, and many different types of individual brackets are needed to assemble a complete bracket set for a single patient. In common with most intraoral orthodontic appliances, brackets are very small and relatively expensive components, and quantities of a specific bracket type have conventionally been stored in individual small envelopes or vials.

Dispensing of brackets from individual packages is time consuming and inconvenient for the orthodontist, and requires selection, opening and closing of many containers to assemble a bracket set. The box of this invention solves this problem by providing an attractive multicompartment container which houses many bracket types in secure isolation, while making the brackets easily and conveniently accessible when a bracket set is prepared.

SUMMARY OF THE INVENTION

This invention is directed to a box assembly comprising a base defining a plurality of spaced-apart and upwardly open depressions or cavities for receiving small parts. The base has sidewalls, the upper facing surfaces of which define mortise-tenon sliding joints with the edges of a closure panel or lid movably mounted on the base. The lid normally covers the cavities to prevent loss or intermixing of separately stored parts, but is movable to an open position to expose the cavities when parts are to be removed.

The bottom surface of the lid rests on and slides over a substantially planar surface on the base at the level of the cavity tops, and one of the surfaces defines a slot or depressed groove which is elongated in the direction of lid movement. The other surface defines a button or detent which extends into and mates with the groove. The groove has closed ends to retain the lid on the base, and is shallowed adjacent one end to provide a stop for retaining the lid in the closed position.

Preferably, the base is made of a vacuum-formed plastic sheet, and the lid is a transparent plastic panel which can be economically injection molded. A preferred embodiment further includes reliefs in the tenon parts of the sliding lid joint for minimizing friction and providing smooth movement.

BRIEF DESCRIPTION OF THE DRAWINGS

FIG. 2 is a top view of a sliding cover or lid for the box;

FIG. 3 is a sectional view on line 3—3 of FIG. 2;

FIG. 4 is a sectional view on line 4—4 of FIG. 2;

FIG. 5 is a sectional view on line 5—5 of FIG. 2;

FIG. 6 is an enlarged side view of a lid end rail portion designated by line 6—6 in FIG. 2;

DESCRIPTION OF THE PREFERRED EMBODIMENT

Figure 1:
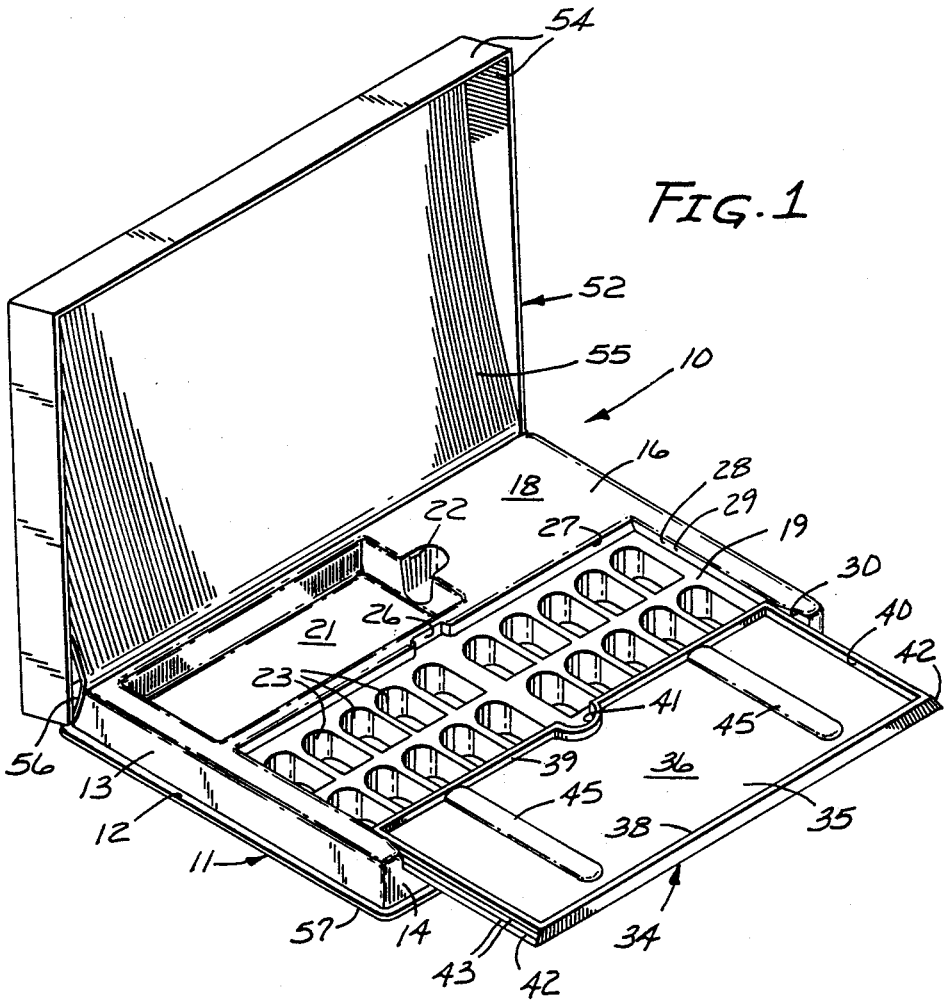
FIG. 1 is a pictorial view of a box assembly according to the invention.
Figure 7:
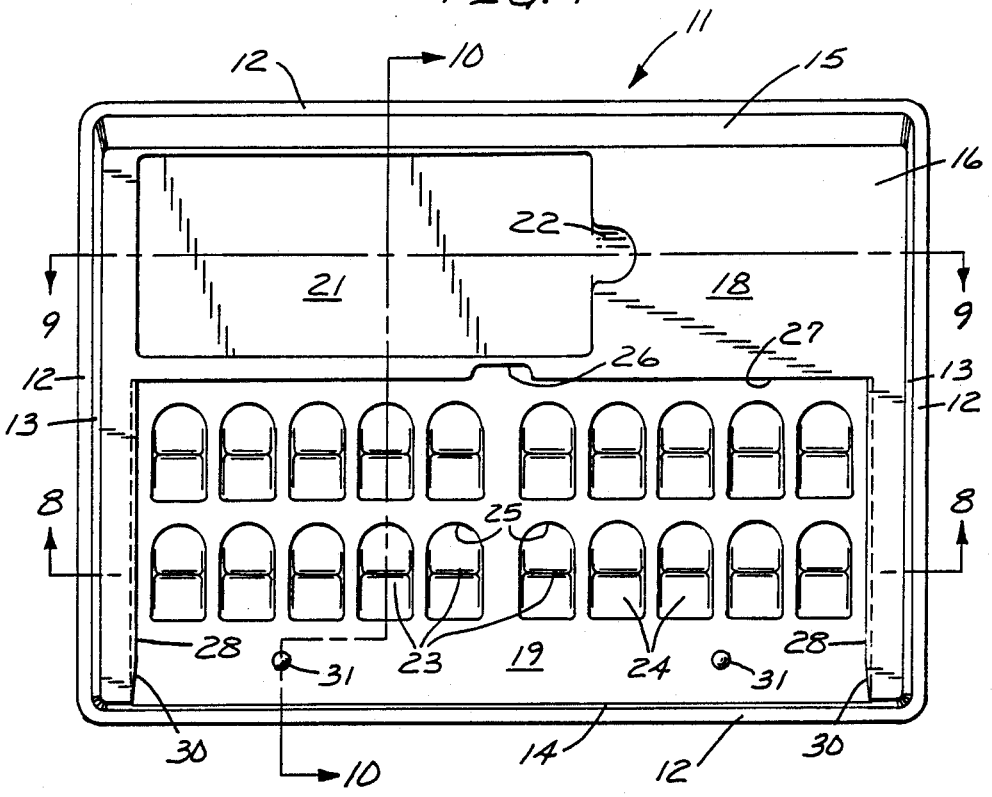
FIG. 7 is a top view of a base for the box.
Figure 8:
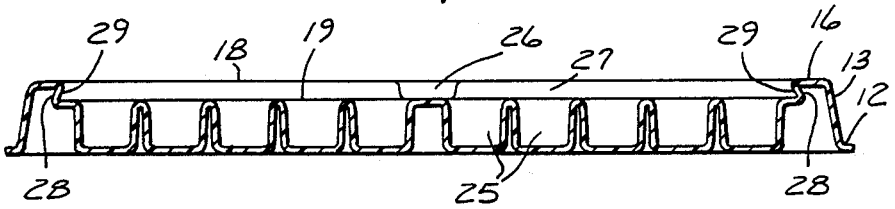
FIG. 8 is a sectional view on line 8—8 of FIG. 7.
Figure 9:
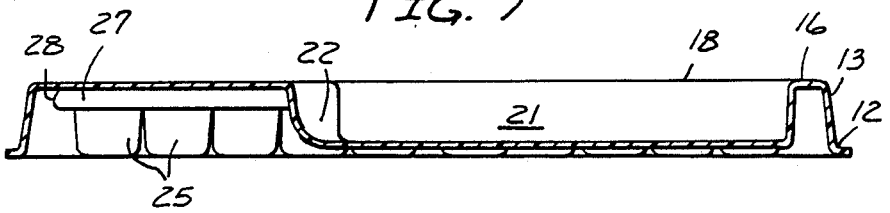
FIG. 9 is a sectional view on line 9—9 of FIG. 7.
Figure 10:
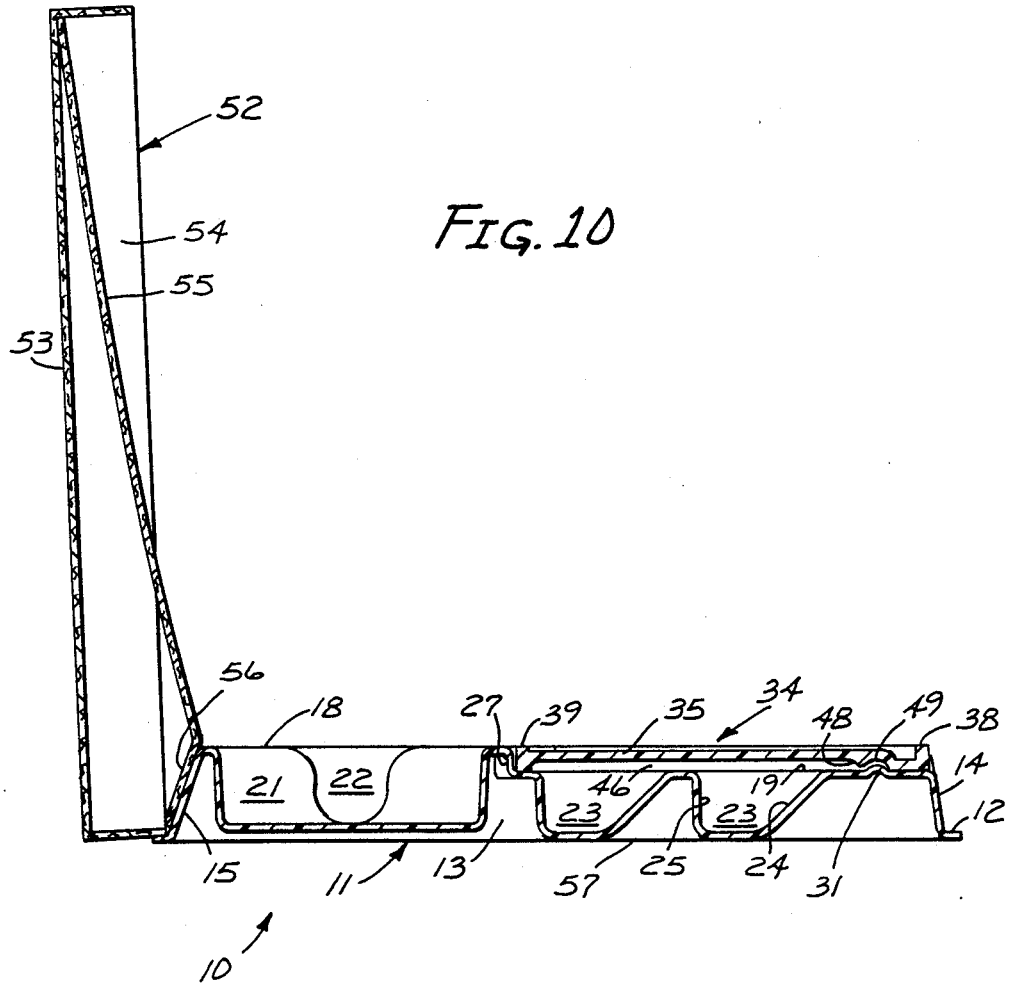
FIG. 10 is a sectional view on line 10—10 of FIG. 7, and showing the assembled lid, base and a cover.

FIG. 1 is a pictorial view of a multicompartment container or box 10 according to the invention, and having a base 11 shown in detail in FIGS. 7–10. The base is preferably a vacuum-formed plastic sheet, and high-impact polystyrene of about 0.040-inch thickness is a suitable material.

The perimeter of base 11 has an outwardly turned horizontal flat rim 12 integrally secured to upwardly sloping side panels 13, and upwardly sloping front and rear panels 14 and 15 respectively. A top panel 16 is integrally secured to the upper edges of the side, front and rear panels, and the top panel has a generally flat upper surface 18 which is depressed in a forward part of the base to define a planar intermediate surface 19.

Top-panel upper surface 18 has toward one side of its rear portion a depression defining a large rectangular cavity 21 (FIGS. 1, 7 and 9–10) with a further small extended depression defining a fingertip opening 22. Intermediate surface 19 of the top panel has a plurality of relatively small depressions arranged in two aligned rows and defining spaced-apart parts cavities 23 with sloping front surfaces 24 and curved rear surfaces 25. A small and centrally positioned fingertip depression 26 is formed just behind the rear row of parts cavities.

The upper and intermediate surfaces 18 and 19 of the top panel are connected by a short upright rear wall 27 (FIGS. 1 and 10) and a pair of opposed sidewalls 28 (FIG. 8) which slope outwardly and downwardly to define elongated horizontal channels 29 which terminate rearwardly at rear wall 27. Forward ends of the channels 29 are shallowed by slight outward curvature 30 of sidewalls 28 to widen the entrance opening between the channels 29. A pair of laterally spaced-apart and generally hemispherical projections or buttons 31 (FIGS. 7 and 10) are integrally formed in the top panel to extend upwardly from intermediate surface 19 just forward of the front row of parts cavities 23.

The other major component of box 10 is a lid or top closure panel 34 (FIGS. 1-5) which is preferably an injection-molded transparent sheet of styrene plastic of about one-tenth-inch cross-sectional thickness. Panel 34 can also be machined from a thicker panel of clear Plexiglas plastic, but injection molding is preferred for economy.

The closure panel is of integral construction, and has a wall 35 with upper and lower surfaces 36 and 37. The perimeter of the wall upper surface extends slightly upwardly to define front and rear ribs 38 and 39, and a pair of opposed side ribs 40. A centrally positioned and forwardly extending depression in rear rib 39 defines a fingertip opening 41.

The spacing of side ribs 40 corresponds to the spacing of sidewalls 28 of base 10, and outer surfaces or edges 42 of the side ribs slope outwardly and downwardly to mate with channels 29 of the base. Preferably, small elongated grooves or depressions 43 (FIG. 6) are formed along the length of the side-rib outer edges 42 to reduce the surface area and thereby minimize sliding frictional drag between the assembled closure panel and base.

A pair of elongated, parallel and generally semicylindrical spaced-apart depressions 45 extend upwardly from wall 35 to define tracks or grooves 46 which mate in sliding engagement with buttons 31 on the box base. Both grooves 46 extend rearwardly adjacent the inner surface of front rib 38, and terminate at rear ends 47 at rear rib 39. Each groove 46 is shallowed just forward (by a distance only slightly more than the diameter of hemispherical buttons 31) of its front end to define a downwardly extending detent 48 forming a button socket 49.

Box 20 is preferably completed by a hinged cover 52 (FIGS. 1 and 10) made of a printable chipboard or cardboard attractively laminated with a thin and durable sheet of Mylar plastic. The cover has a top panel 53 with a depending sidewall 54 around its perimeter, and is dimensioned to close and fit snugly over base 11 when in a closed position. A flexible plastic sheet 55 is glued or otherwise secured to the inside of the front and rear sidewalls and a rear portion 56 of the undersurface of sheet 55 is glued to rear panel 15 of base 11 to provide hinge mounting of the cover to the base. Preferably, the undersurface of base 11 is covered by a flat sheet 57 of plastic material (0.015-inch-thick polystyrene is suitable) which is adhered to the bottom of base rim 12.

Box 10 is assembled by slipping closure panel 34 into base 11 with beveled outer edges 42 engaged in channels 29 to form a sliding connection in the style of a mortise-tenon joint. This initial assembly step is simplified by slanting the closure panel to elevate slightly the panel leading edge, and if necessary by pressing downwardly the resilient sheet material of the base panel to depress buttons 31 for clearance beneath the closure-panel undersurface adjacent groove rear ends 47.

The engaged closure panel is then slipped easily toward a closed position, and additional closure force causes buttons 31 to deflect resiliently beneath groove detents 48 to seat the buttons in groove sockets 49, thereby releasably locking the closure panel in a closed position which covers and effectively seals parts cavities 23. Parts in the individual cavities are thereby captive, and unwanted intermixing of unlike parts is prevented.

The closure panel is easily opened by positioning a fingertip in the space formed by depression 26 and opening 41, and applying sufficient force to move the panel in an opening direction with buttons 31 deflecting beneath detents 48. The closure panel then slides freely to a fully open position which exposes the parts cavities, but separation from the base is prevented when groove rear ends 47 contact buttons 31.

Preferably, the surface of each detent 48 which forms part of socket 49 is sloped at about 33 degrees to the major plane of the closure panel to provide a linear ramp which rides easily over associated button 31 when the panel is moved away from the closed position. Buttons 31 cooperate with grooves 46 as tracks or guides to avoid unwanted cocking of the closure panel which could interfere with smooth opening and closing movement.

When used in an orthodontic application, box 10 as illustrated is provided with twenty parts cavities to house orthodontic brackets for the incisor, cuspid and bicuspid teeth of both dental arches. The cavities are arrayed in two center-separated rows to store five brackets for each of the quadrants of the upper and lower arches. In such usage, large rectangular cavity 21 provides storage space for a supply of self-adhesive sheets or plates (not shown) on which a full set of brackets can be temporarily positioned in readiness for intraoral placement.

There has been described a container or box which provides secure isolation during shipment and handling of separate sets of orthodontic brackets or similar components, while still providing quick and easy access to the components by sliding a detent-lockable and self retaining closure panel to an open position. The box is attractive and economical to produce, and while specifically designed for storage and dispensing of orthodontic brackets, is believed to be useful with other styles of small parts which must not be intermixed.

What is claimed is:

1. A storage and dispensing box, comprising:

a base having generally parallel upper, intermediate and bottom surfaces joined by common spaced-apart sidewalls, the intermediate surface being positioned between the upper and bottom surfaces, being generally planar, and defining a plurality of open-top and downwardly closed cavities extending toward the bottom surface, said base having an elongated channel formed in at least one of said sidewalls, and a closure panel having an elongated edge slidably engaged with the channel of the base to be movable into open and closed positions which respectively expose and cover the cavities, the closure panel having a bottom surface which rests on the base intermediate surface;

one of the base intermediate and panel bottom surfaces defining a projecting button, and the other of said surfaces defining a groove extending in the direction of elongation of said channel and said edge, and in the direction of panel movement, said groove receiving the button, the groove having an end with a socket which receives the button when the panel is in the closed position, the groove having a shallowed portion adjacent said end and defining a detent whereby the panel is retained in the closed position and can be opened only by forcing the detent past the button.

2. The box defined in claim 1 wherein the base is made of thermoformable plastic sheet material.

3. The box defined in claim 2 wherein the base upper surface defines an upwardly open depressed cavity which is larger than the cavities in the intermediate surface, and which is not covered by the closure panel in any portion.

4. A box for storage and dispensing of orthodontic brackets arranged in sets, comprising:

a vacuum-formed panel of thermoformable plastic material having generally parallel upper, intermediate and bottom surfaces joined by spaced-apart sidewalls; the intermediate surface being depressed below the upper surface and extending above the bottom surface, defining a plurality of open-top and downwardly closed parts cavities extending toward the bottom surface, and having adjacent a forward edge a pair of upwardly extending and laterally spaced-apart buttons; the sidewalls defining elongated channels;

a generally planar closure panel having elongated edges which interfit with the box sidewall channels to form a sliding connection between the closure panel and base and enable the panel to slide relative to the base; the closure panel having an undersurface defining a pair of downwardly opening grooves aligned with and receiving respective buttons, and which are elongated in a direction parallel to said edges and to said channels, and parallel to the direction of sliding movement of the panel between an open position which exposes the parts cavities and a closed position which effectively seals the cavities against escape of parts, the grooves terminating short of front and rear closure-panel edges to capture the closure panel on the base; the grooves further having shallowed portions adjacent rear grooves ends to form detents and sockets to retain the closure panel releasably in the closed position.

5. The box of claim 4 in which the base defines about twenty parts cavities.

6. The box of claim 5 wherein the parts cavities are arranged in two parallel rows with central separations to store brackets separately for each of four dental-arch quadrants.

7. The box of claim 6 wherein the base upper surface further defines a depressed cavity which is larger than the parts cavities, and which is not covered by the closure panel in any position.

8. The box of claim 4 wherein said closure-panel edges define elongated grooves to reduce the edge surface area in sliding contact with the base.

* * * * *